United States Patent [19]

Quiogue

[11] Patent Number: 4,931,915

[45] Date of Patent: Jun. 5, 1990

[54] SEALING SYSTEM FOR GRADE MOUNTED LIGHT FIXTURE

[75] Inventor: Honesto D. Quiogue, Florence, Ky.

[73] Assignee: Hubbell Incorporated, Orange, Conn.

[21] Appl. No.: 327,546

[22] Filed: Mar. 23, 1989

[51] Int. Cl.[5] ..... F21V 31/00

[52] U.S. Cl. ..... 362/267; 362/153.1; 362/375

[58] Field of Search ..... 362/153.1, 267, 364, 362/374, 375

[56] References Cited

U.S. PATENT DOCUMENTS

| | | | |
|---|---|---|---|
| 1,853,321 | 4/1932 | Rogers | 362/153.1 X |
| 2,038,506 | 4/1936 | Cadieux | 362/153 |
| 2,631,247 | 3/1953 | Shaw | 362/276 |
| 3,264,466 | 8/1966 | Bacon | 362/362 |
| 3,274,392 | 9/1966 | Harling | 250/239 |
| 3,543,099 | 11/1970 | Turner | 250/226 |
| 3,880,528 | 4/1975 | Petersen et al. | 250/239 |
| 4,207,464 | 6/1980 | Fukuyama et al. | 250/239 |
| 4,343,032 | 8/1982 | Schwartz | 362/802 |
| 4,382,274 | 5/1983 | De Backer | 362/153 |
| 4,543,623 | 9/1985 | Ehret | 362/267 |
| 4,617,615 | 10/1986 | Eychaner | 362/267 X |
| 4,791,290 | 12/1988 | Noone | 250/214 AL |

OTHER PUBLICATIONS

Imperial Bronzelite brochure, Advanced Grade--Mounted Landscape Lighting, pp. 4–6 1987.

*Primary Examiner*—Stephen F. Husar

*Attorney, Agent, or Firm*—Jerry M. Presson; Mark S. Bicks; Alfred N. Goodman

[57] ABSTRACT

A light fixture includes a lamp housing, a removable cover, a light transparent lens, a lamp and a gasket. The lamp housing has a hollow interior and an open top. The removable cover is releasably coupled to the housing and extends over and laterally beyond the open top, and has an aperture extending through it. The cover also has depending ribs. The gasket is mounted between and seals joints between the lens, the cover and the housing. The gasket is confined between the ribs to ensure its proper alignment.

21 Claims, 3 Drawing Sheets

SEALING SYSTEM FOR GRADE MOUNTED LIGHT FIXTURE

FIELD OF THE INVENTION

The present invention relates to a sealing system for a grade-mounted outdoor light fixture. The fixture includes a lamp housing, a removable cover releasably coupled to the housing and extending laterally beyond the housing, a light transparent lens mounted in an aperture in the cover, and a gasket mounted between and sealing the joints between the lens, the cover and the housing.

BACKGROUND OF THE INVENTION

Grade-mounted light fixtures perform a variety of desirable functions, such as illuminating the facades and exteriors of buildings, creating aesthetic light and shadow effects in a range of architectural and landscape settings, and providing safety and security lighting around commercial and industrial buildings. Such lighting is grade-mounted because the fixtures are installed in recesses in landscapes adjacent buildings so that the uppermost surface of the light fixture is substantially flush or coplanar with the landscape surface.

Light fixtures installed in recesses in the landscape require special consideration in design and construction. Specifically, the light fixture must be as water tight as possible to avoid the corrosive effects of soil, plants, concrete or other material having a corrosive effect on the internal electrical components of the light fixture. Additionally, the cover for the housing must still be removable to permit access to the housing interior for lamp replacement without total removal and replacement of the light fixture.

SUMMARY OF THE INVENTION

An object of the present invention is to provide a light fixture which is effectively sealed to permit use of the fixture outdoors and mounted in grade.

Another object of the present invention is to provide a light fixture with an effective sealing system which is simple and inexpensive to manufacture.

A further object of the present invention is to provide a light fixture with a reliable sealing system permitting removal of its cover to allow ready access to the lamp while the fixture remains mounted in grade.

The foregoing objects are obtained by a light fixture comprising a lamp housing, a removable cover, a light transparent lens, a lamp and a gasket. The lamp housing has a hollow interior and an open top. The removable cover is releasably coupled to the housing over, extends laterally beyond the open top, and has an aperture extending therethrough and depending ribs. The light transparent lens is mounted in the aperture. The lamp is mounted within the interior of the housing for directing light through the lens. The gasket is mounted between and seals joints between the lens, the cover and the housing. The gasket is confined between the ribs to ensure proper alignment of the gasket.

By forming the light fixture in this manner, the fixture is effectively sealed preventing entry of water and other contaminants, even when buried in different soil conditions and exposed to rain, snow, water sprinkle or hose spraying for cleaning the lens. The cover ribs keep the gasket in place providing proper alignment and mating with the housing. Such proper alignment is maintained even after repeated removal and remounting of the cover on the lamp housing.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
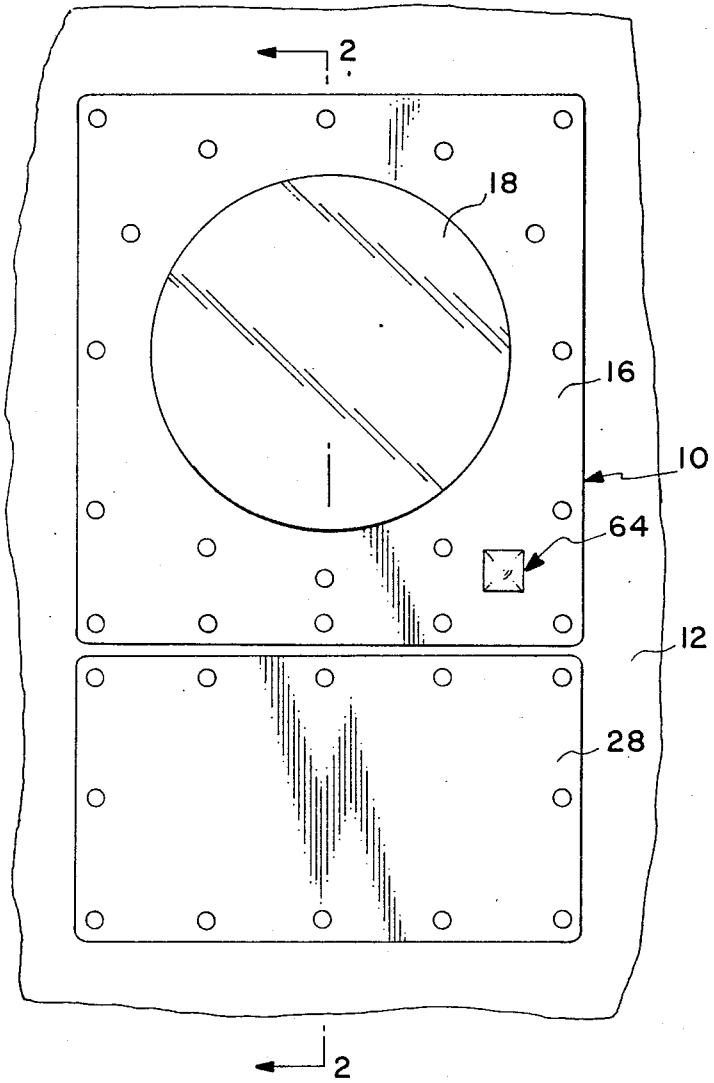
FIG. 1 is a top plan view of a light fixture according to the present invention.
Figures 2, 5, 7, 8:
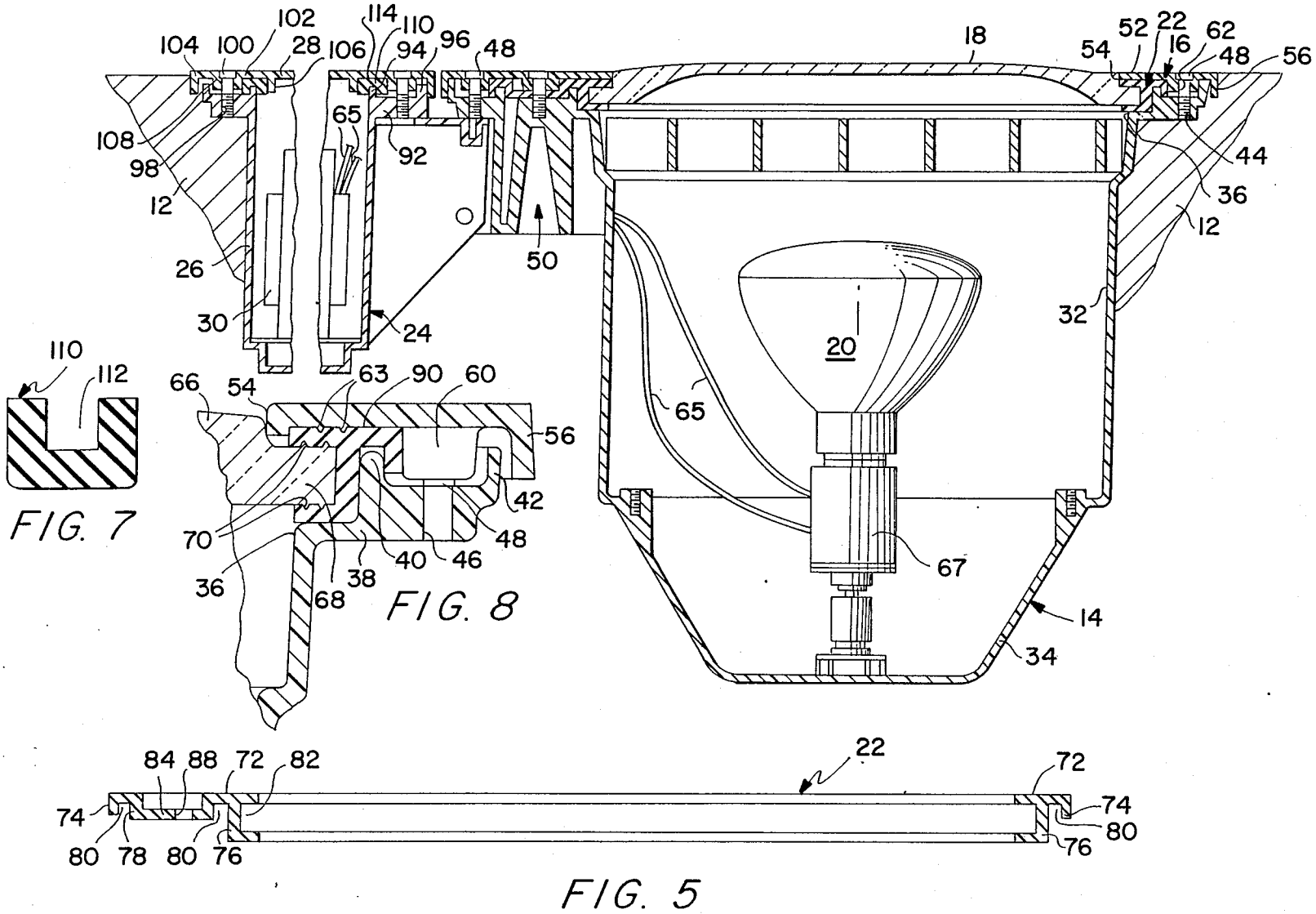
FIG. 2 is a side elevational view in section of the light fixture, taken along lines 2—2 of FIG. 1.
FIG. 5 is a side elevational view in section of the gasket taken along lines 5—5 of FIG. 4.
FIG. 7 is a side elevational view in section of the ballast housing gasket taken along lines 7—7 of FIG. 6.
FIG. 8 is an enlarged, partial side elevational view in section of the light fixture of FIG. 1.

Referring initially to FIGS. 1 and 2, the light fixture 10 of the present invention, is mounted in a hole or recess formed in a graded landscape environment 12. The light fixture comprises a lamp housing 14 a removable cover 16 coupled to lamp housing 14, a light transparent lens 18 mounted in the cover, a lamp 20 mounted in the interior of the housing, and a gasket 22 mounted between and sealing the joints between the lens, cover and housing.

Releasably coupled to the lamp housing is a ballast housing 24. Balanced housing 24 comprises a ballast base 26 and a ballast cover 28 for enclosing a light fixture ballast 30.

Lamp housing 24 comprises a hollow interior 32. The lamp housing is closed at bottom 34 but is opened at its top 36.

As best illustrated in FIG. 8, a horizontal flange 38 extends laterally outwardly from the lamp housing base about its entire periphery at open top 36. An inner upright wall 40 and an outer upright wall 42 extend upwardly from horizontal flange 38. Upright walls 40 and 42 are generally concentric, i.e., are generally equally spaced from each other about the entire periphery of the housing, and form a rectangular shape in plan view. Outer upright wall 42 is located generally at the remote end of flange 38, while inner upright wall 40 is spaced inwardly from outer upright wall 42. The inner and outer upright walls define a peripheral channel about the housing.

The flange includes internally threaded bores 44 (see FIG. 2) and drain openings or holes 46 (see FIG. 8) between upright walls 40 and 42. The threaded bores receive fasteners 48 for securing cover 16 to housing 14. The drain openings or holes drain any liquid contaminants passing inside of outright wall 42, but before such liquid contaminants can pass into the housing interior and damage the electrical components enclosed within that housing.

The lamp housing also has an electrical component receiving compartment 50 on one side thereof inside of horizontal flange 38. Such compartment receives wiring and other electrical controls for the fixture.

Cover 16 for lamp housing 14 comprises a generally planar top member 52 which extends over and laterally beyond open top 36. The center of the cover has an aperture 54 extending through it. About the entire periphery of top member 52, the cover has a depending peripheral flange 56. Peripheral flange 56 extends downwardly to a point below the uppermost edge of outer upright wall 42 and overlaps outer upright wall 42 of the housing.

Figure 3:
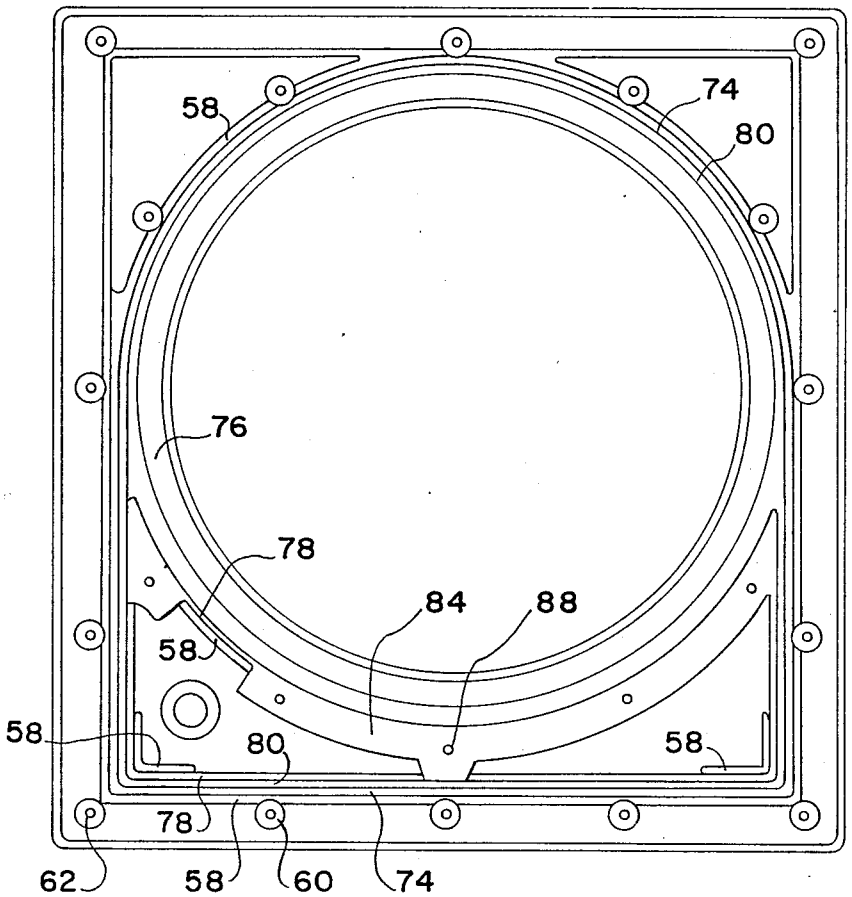
FIG. 3 is a bottom plane view of the cover and gasket of the light fixture of FIG. 1, with the lens removed.

Between peripheral flange 56 and aperture 54, the cover has a plurality of depending ribs 58. These ribs connect bosses 60 depending from the cover about bores 62 which receive fasteners 48. The ribs strengthen the cover and provide an alignment mechanism for gasket 22. Specifically, the ribs define a channel which properly positions the gasket and maintains it in place, even after repeated openings and closings of the cover. The pattern of the ribs is best illustrated in FIG. 3. A pair of annular pressure projections 63 depend downwardly outside of aperture 54.

Cover 16 also supports a photocontrol device 64. the photocontrol device is disclosed in U.S. patent application Ser. No. 176,318, entitled PHOTOCONTROL DEVICE FOR GRADE MOUNTED LIGHT FIXTURE and filed Mar. 31, 1988, now U.S. Pat. No. 4,907,139 the subject matter of which is hereby incorporated by reference.

Lamp 20 can be any suitable incandescent lamp, particularly high intensity discharge lamp. The lamp is mounted in a suitable socket 67 fixed in the lamp housing interior. Socket 67 is electrically connected to photocontrol device 64 and to ballast 30 by wires 65.

Lens 18 is generally in a shape of a circular disk having a raised center portion 66 and an annular peripheral flange 68. Flange 68 comprises two pairs of concentric annular ridges or pressure projections 70.

Lamp housing gasket 22 is formed of a resilient elastomer, for example, molded silicone. The gasket comprises a flat upper portion 72 which faces and engages the cover between the depending ribs on the cover. An outer flange 74 depends downwardly from upper portion 72 about the entire periphery of gasket 22. Outer flange 74 is generally semi-circular in plan view in its upper section as illustrated in FIG. 3, but is generally semi-rectangular in its lower portion as illustrated in FIG. 3. Inside of outer flange 74, the gasket comprises a first inner flange 76 and a second inner flange 78. The inner flanges also depend from upper portion 72, and with outer flange 74 define a continuous groove 80 between the flanges.

First inner flange 76 is generally L-shaped in cross section, as illustrated in FIG. 5, forming a laterally inwardly opening annular recess 82 with upper portion 72. Recess 82 receives peripheral flange 68 of lens 18, as illustrated in FIG. 8. Upon closing of the cover, the upper portion of the gasket and the lower leg of the L-shaped inner flange 76 engage opposite surfaces of lens peripheral flange 68 forming a tight seal therebetween.

Second inner flange 78 lies laterally between first inner flange 76 and a semi-rectangular portion of outer flange 74. The second inner flange defines a closed geometric figure. One section of inner flange 78 is generally semi-rectangular and spaced inwardly and parallel to the semi-rectangular portion of outer flange 74. The other section of the second inner flange is generally semi-circular in plan view and spaced outwardly from and parallel to an adjacent portion of first inner flange 76. In this manner, the gasket flanges 74, 76 and 78 define a continuous groove 80 which receives the inner upright wall 40 of the housing, as well as the upright wall surrounding the cylindrical portion of the lamp housing base.

Gasket 22 also has horizontal flanges 84 and 86 connecting lowermost edges of sections of second inner flange 78. These flanges extend over some of the cover ribs as illustrated in FIG. 3. Holes 88 are formed in portions of flanges 84 and 86 where such flanges overlap the bores 62 in bosses 60 to permit fasteners 48 to pass through the gasket, as necessary. Flanges 84 and 86 of the gasket enhance its structural integrity.

Gasket 22 is secured to cover 16 by a suitable adhesive 90. The adhesive retains the gasket with a cover when the cover is removed from the lamp housing, and enhances the sealing.

The upper portion of the ballast housing base 26, like the lamp housing, comprises a horizontal flange 92 within an inner upright wall 94 and an outer upright wall 96. Between the inner and outer upright walls, horizontal flange 92 comprises a number of internally threaded bores 98 for receiving fasteners 100 securing ballast cover 28 to ballast housing base 26. Additionally, flange 92 comprises drain openings, identical to openings 46 in flange 38 to drain any liquid entering between upright walls 94 and 96.

Ballast cover 28 comprises a top member 102 a peripheral flange 104 depending from the periphery of top member 102. Peripheral flange 104 extends downwardly to a point below the uppermost edge of outer upright wall 96 of ballast housing 24 and overlaps outer upright wall 96.

Inside of peripheral flange 104, ballast cover 28 comprises a plurality of depending ribs 106. These ribs connect bosses 108 depending from ballast cover 28 about bores receiving fasteners 100. Other ribs are spaced from the ribs connecting the bosses. In this manner, the ribs define a channel.

Figure 6:
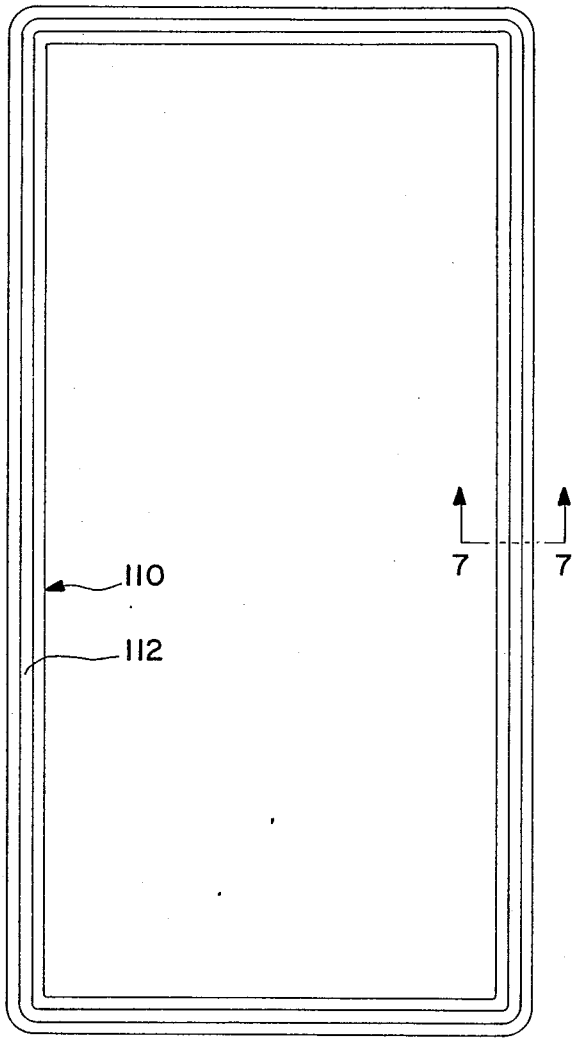
FIG. 6 is a bottom plan view of the ballast housing gasket of the light fixture of FIG. 1.
Figure 4:
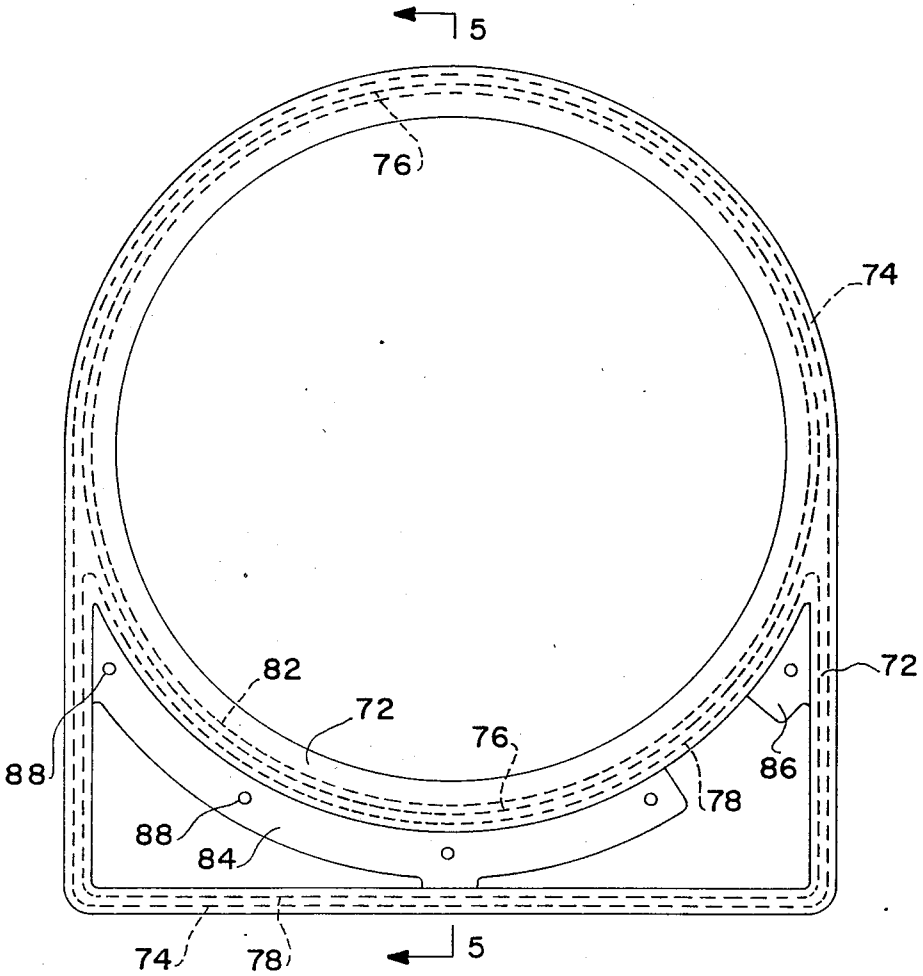
FIG. 4 is a top plan view of the gasket of the light fixture of FIG. 1.

A gasket 110 is located in the channel defined by the ribs of the ballast cover 28. Gasket 110, is formed of a resilient elastomer, for example silicone. As illustrated in FIGS. 6 and 7, the gasket is generally rectangular in plan view so as to be confined between the depending ribs of the ballast cover 28. Additionally, it is generally U-shaped in transverse cross section (FIG. 7) forming a groove 112. Groove 112 receives inner upright wall 94 of ballast housing 24.

As illustrated in FIG. 2, gasket 110 is secured to ballast cover 28 by an adhesive 114 such that groove 112 opens downwardly to engage inner upright wall 94.

While a particular embodiment has been chosen to illustrate the invention, it will be understood by those skilled in the art that various changes and modifications can be made therein without departing from the scope of the invention as defined in the appended claims.

What is claimed is:

1. A light fixture, comprising:

a lamp housing having a hollow interior and an open top;

a removable cover releasably coupled to said housing extending over and laterally beyond said open top, said cover having an aperture extending therethrough and depending ribs;

a light-transparent lens mounted in said aperture;

a lamp mounted within said interior of said housing for directing light through said lens; and gasket means, mounted between said lens, said cover and said housing, for sealing joints therebetween, said gasket means being confined between said ribs to ensure proper alignment of said gasket means.

2. A light fixture according to claim 1 wherein said housing comprises a base depending from said open top, a horizontal flange extending laterally from said base at said open top, and inner and outer, generally concentric, upright walls extending upwardly from said horizontal flange.

3. A light fixture according to claim 2 herein said horizontal flange comprises drain openings between said upright walls.

4. A light fixture according to claim 2 wherein said cover comprises a peripheral flange extending downwardly, said peripheral flange overlapping said outer upright wall of said housing.

5. A light fixture according to claim 1 wherein said cover comprises a peripheral flange extending downwardly below said open top of said housing.

6. A light fixture according to claim 1 wherein said cover comprises bores receiving fasteners securing said cover to said housing and depending bosses about said bores, said ribs connecting said bosses.

7. A light fixture according to claim 1 wherein said cover comprises two depending annular cover projections pressing against said gasket means.

8. A light fixture according to claim 1 wherein said gasket comprises a laterally inwardly opening annular recess; and said lens comprises a laterally extending flange received in said recess.

9. A light fixture according to claim 8 wherein said flange of said lens comprises annular pressure projections pressing against said gasket means.

10. A light fixture according to claim 9 wherein said cover comprises two depending annular cover projections pressing against said gasket means.

11. A light fixture according to claim 1 wherein said gasket means is bonded to said cover by adhesive.

12. A light fixture according to claim 1 wherein said gasket means comprises an upper flat portion facing said cover, a depending outer flange, first and second depending inner flanges, and a continuous groove defined between said flanges.

13. A light fixture according to claim 12 wherein said first inner flange defines a laterally inwardly opening annular recess with said upper flat portion, said annular recess receiving said lens.

14. A light fixture according to claim 12 wherein said second inner flange lies laterally between said first inner flange and a portion of said outer flange.

15. A light fixture according to claim 14 wherein said second inner flange is continuous and defines a closed geometric figure.

16. A light fixture according to claim 12 wherein said housing comprises a base depending from said open top, a horizontal flange extending laterally from said base at said open top, and inner and outer, generally concentric, upright walls extending upwardly from said horizontal flange, said inner upright wall being received in said continuous groove.

17. A light fixture according to claim 16 wherein said flange comprises drain openings between said upright walls.

18. A light fixture according to claim 1 wherein a ballast housing is coupled to said lamp housing, said ballast housing having a ballast base with an open top and a ballast cover coupled to said ballast base and extending over and laterally beyond said open top of said ballast housing, said ballast cover having depending ballast ribs; and ballast gasket means is mounted between said ballast base and said ballast cover for sealing joints therebetween, said ballast gasket being confined between said ballast ribs to ensure proper alignment of said ballast gasket means.

19. A light fixture according to claim 18 wherein said ballast housing base comprises a ballast horizontal flange extending laterally from said open top thereof, and inner and outer, generally concentric walls extending upwardly from said horizontal flange.

20. A light fixture according to claim 19 wherein said ballast gasket means comprises a continuous groove receiving said inner wall.

21. A light fixture, comprising:

a lamp housing having a hollow interior, an open top, a base depending from said open top, a horizontal flange extending laterally from said base at said open top, and inner and outer generally concentric, upright walls extending upwardly from said horizontal flange, said horizontal flange having drain openings between said upright walls;

a removable cover releasably coupled to said housing over and laterally beyond said open top, said cover having an aperture extending therethrough, depending ribs, a peripheral flange extending downwardly below said open top and overlapping said outer upright wall of said housing, bores for fasteners and depending bosses about said bores, said ribs connecting said bosses;

fasteners extending through said bores in said cover and coupled to said housing between said upright walls;

a light transparent lens mounted in said aperture of said cover;

a lamp mounted within said interior of said housing for directing light through said lens; and a resilient, unitary gasket mounted and sealing joints between said lens, said cover and said lamp housing, said gasket being confined between said ribs to ensure proper alignment thereof, said gasket including an upper flat portion facing said cover, an outer flange, first and second inner flanges and a continuous groove between said flanges, said inner upright wall being received in said continuous groove.

* * * * *